US010870924B2

(12) United States Patent
Gerngross et al.

(10) Patent No.: US 10,870,924 B2
(45) Date of Patent: Dec. 22, 2020

(54) ALUMINUM-COPPER CONNECTOR HAVING A HETEROSTRUCTURE, AND METHOD FOR PRODUCING THE HETEROSTRUCTURE

(71) Applicant: Christian-Albrechts-Universitaet zu Kiel, Kiel (DE)

(72) Inventors: Mark-Daniel Gerngross, Reutlingen (DE); Melike Baytekin-Gerngross, Reutlingen (DE); Juergen Carstensen, Kiel (DE); Rainer Adelung, Kiel (DE)

(73) Assignee: Christian-Albrechts-Universitaet zu Kiel, Kiel (DE)

( * ) Notice: Subject to any disclaimer, the term of this patent is extended or adjusted under 35 U.S.C. 154(b) by 0 days.

(21) Appl. No.: 16/320,204

(22) PCT Filed: Jun. 3, 2017

(86) PCT No.: PCT/DE2017/100472
§ 371 (c)(1),
(2) Date: Jan. 24, 2019

(87) PCT Pub. No.: WO2018/019321
PCT Pub. Date: Feb. 1, 2018

(65) Prior Publication Data

US 2019/0264346 A1 Aug. 29, 2019

(30) Foreign Application Priority Data

Jul. 25, 2016 (DE) ..... 10 2016 113 641

(51) Int. Cl.
*C25D 5/44* (2006.01)
*C25D 7/06* (2006.01)
(Continued)

(52) U.S. Cl.
CPC ..... *C25D 5/44* (2013.01); *C25D 5/38* (2013.01); *C25D 7/0607* (2013.01);
(Continued)

(58) Field of Classification Search
CPC ... C25D 5/44; C25D 5/38; C25D 7/00; C25D 7/0607; C25D 7/0614; H01R 13/03; C25F 3/04
See application file for complete search history.

(56) References Cited

U.S. PATENT DOCUMENTS 1,457,149 A 5/1923 Cunningham
1,947,981 A 2/1934 Fischer
(Continued)

FOREIGN PATENT DOCUMENTS

DE 1496956 A1 11/1969
EP 0003125 A1 7/1979
(Continued)

OTHER PUBLICATIONS

International Search Report dated Oct. 2, 2017, in International Application No. PCT/DE2017/100472.
(Continued)

*Primary Examiner* — Daniel J. Schleis
*Assistant Examiner* — Kevin Ct Li
(74) *Attorney, Agent, or Firm* — Patent Central LLC; Stephan A. Pendorf

(57) ABSTRACT

A heterostructure comprising at least one first surface containing only copper and at least one second surface, opposite the first surface, containing only aluminium or an aluminium alloy with solid solutions present in the alloy, wherein a. an anchoring layer is arranged between the first and second surfaces, wherein b. each slice plane running perpendicular to the anchoring layer has at least one aluminium or aluminium-alloy island surrounded by copper, and c. at most
(Continued)

Figure 1:
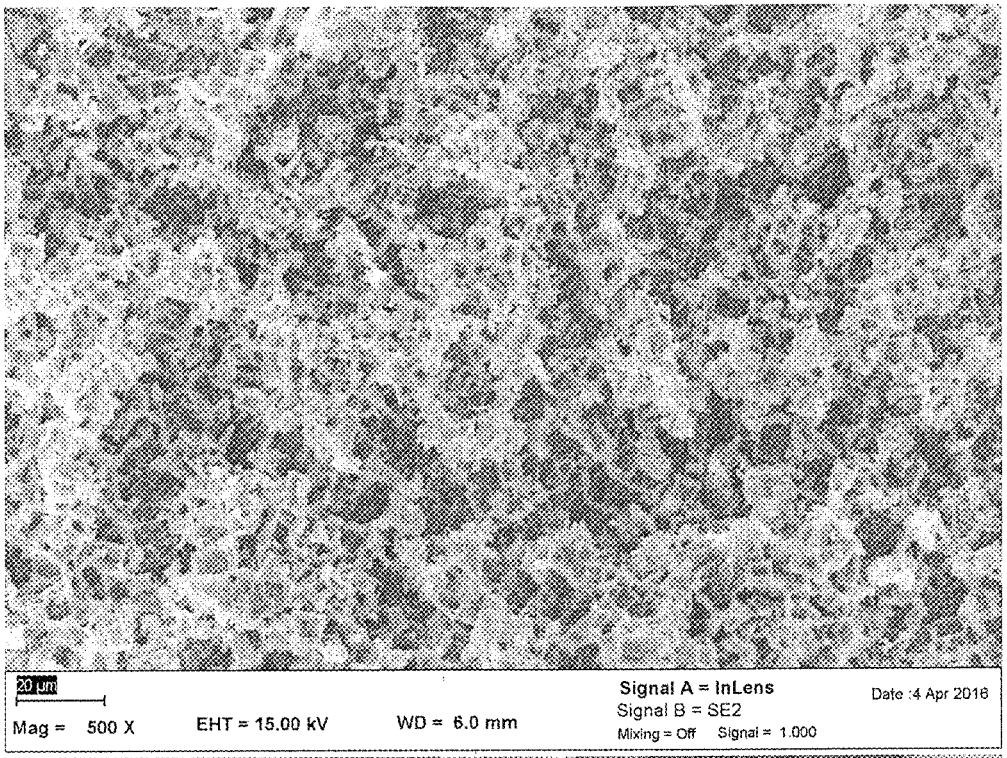
Fig. 1 (Prior Art)
Figure 1:
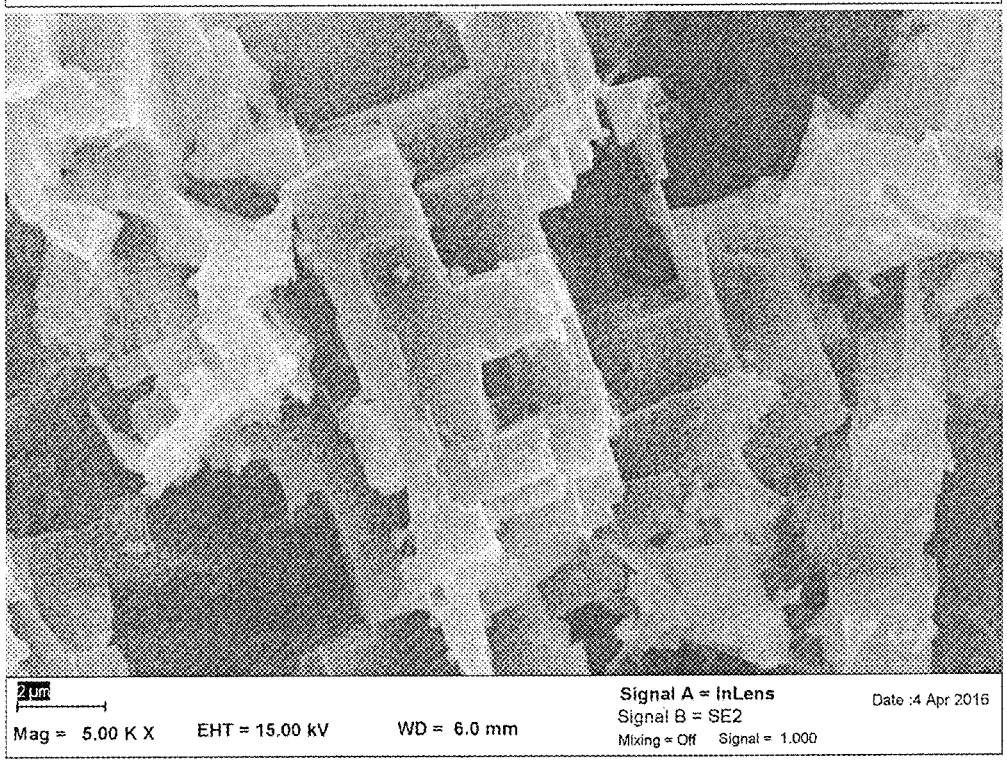
Fig. 1 (Prior Art)

the aluminium alloy solid solutions which are present in the alloy occur in the anchoring layer. Also, an aluminium-copper connector and a heterostructure production method.

3 Claims, 4 Drawing Sheets

(51) Int. Cl.

| | |
|---|---|
| ***C25F 3/04*** | (2006.01) |
| ***C25D 5/38*** | (2006.01) |
| ***H01R 13/03*** | (2006.01) |
| *C25D 7/00* | (2006.01) |

(52) U.S. Cl.
CPC ..... *C25D 7/0614* (2013.01); *C25F 3/04* (2013.01); *H01R 13/03* (2013.01); *C25D 7/00* (2013.01)

(56) References Cited

U.S. PATENT DOCUMENTS

| | | | | |
|---|---|---|---|---|
| 2,495,941 | A | 1/1950 | Mondolfo | |
| 3,335,072 | A | 8/1967 | Cuzner et al. | |
| 3,684,666 | A | 8/1972 | Shaw et al. | |
| 3,876,479 | A | 4/1975 | Yamada | |
| 4,588,486 | A | 5/1986 | Nguyen et al. | |
| 6,238,810 | B1 | 5/2001 | Strange et al. | |
| 6,277,263 | B1 * | 8/2001 | Chen | C25D 5/10 205/182 |
| 6,858,126 | B1 | 2/2005 | Hemphill et al. | |
| 9,520,509 | B2 * | 12/2016 | Kian | H01L 31/02244 |
| 2009/0273885 | A1 | 11/2009 | Jiang et al. | |
| 2013/0264196 | A1 | 10/2013 | Hemphill et al. | |

FOREIGN PATENT DOCUMENTS

| | | | | |
|---|---|---|---|---|
| EP | 0375179 | A2 | | 6/1990 |
| GB | 1338975 | A | | 11/1973 |
| JP | 50160145 | A | | 12/1975 |
| JP | S50160145 | A | * | 12/1975 |

OTHER PUBLICATIONS

M. Baytekin-Gerngross et al: "Surface Structuring of Ti—Al—V and Al—Mg Alloys by Chemical Etching for Advanced Polymer Adhesion", ECS Transactions, vol. 66, No. 22, Jul. 29, 2015 (Jul. 29, 2015) , pp. 19-27, XP055406140, US, ISSN: 1938-6737, DOI: 10.1149/06622.0019ecst, Last paragraph; p. 19; figure 3b, Last paragraph; p. 22, First paragraph; p. 23.

C.J. Hang et al: "Growth behavior of Cu/A1 intermetallic compounds and cracks in copper ball bonds during isothermal aging", Microelectronics and Reliability, Elsevier Science Ltd, GB, vol. 48, No. 3, Feb. 23, 2008 (Feb. 23, 2008), pp. 416-424; XP022496864, ISSN: 0026-2714, DOI: 10.1016/J.MICROREL.2007.06.008,First paragraph; p. 417.

* cited by examiner a)

b)

ALUMINUM-COPPER CONNECTOR HAVING A HETEROSTRUCTURE, AND METHOD FOR PRODUCING THE HETEROSTRUCTURE

The invention relates to a heterostructure formed from the element metal copper (Cu) and pure aluminum (Al) or an aluminum alloy. The invention also relates to a body formed of aluminum or an aluminum alloy which carries on at least part of its surface a thick layer of copper. In particular, the invention relates to an electrically and thermally conductive, robust Al—Cu connector.

In the following description, the term aluminum is to be used for sake of brevity as a collective term for both the pure element metal and for the technically common alloys of predominantly aluminum with manganese, magnesium, copper, silicon, nickel, zinc and beryllium, to the extent that in the context a distinction is not required. If an example of a specific alloy is being discussed, then this will be explicitly named.

Aluminum is known to oxidize very rapidly on its surface upon contact with atmospheric oxygen. In contrast, copper is chemically stable and an excellent conductor of electricity. However, copper is expensive, so that cables for power transmission over long distances today like to resort to aluminum cables. Although the conductance of aluminum is lower, the cables are cheaper even considering the correspondingly larger wire cross-section. The in-house power grids, however, usually consist of copper, and usually at the branch of the main line to a house a connector is already installed, which conducts the current from aluminum to copper. This is not unproblematic, since a vanishing contact resistance is only to be expected if the two elemental metals have a permanent surface area contact with each other. Aluminum and copper, however, do not adhere well to each other, so that even at moderate temperature fluctuations, for example due to the ohmic resistance of the varying current flow, they can come apart from each other. Further problems lie in the interdiffusion of bimetallic compounds, which leads to the formation of brittle, metallic mixed phases in the contact area, see Schneider et al., Long-term Performance of Aluminum-Copper Compounds in Electrical Power Engineering, Metal, No. 11, 2009, pp. 591-594.

In silicon microelectronics, aluminum is the preferred material for electrical contacting, while copper, because of its high solubility and rapid diffusion in silicon, tends to form undesirable mixed crystals with silicon. Especially in the field of integrated circuits (IC) for performance applications, there is often the need to secure copper pads to the aluminum connection pads of the ICs with good conductivity and mechanical stability.

Since the beginning of the 20th century, it is known to interlock the metals copper and aluminum for more stable electrical contacting, for example by electrodeposition of copper after prior roughening of the aluminum surface by means of abrasives, such as sandblasting, or by etching, for example from the documents U.S. Pat. No. 1,457,149 A (1923), U.S. Pat. No. 1,947,981 A (1934), U.S. Pat. No. 2,495,941 A (1950), U.S. Pat. No. 3,684,666 A (1972), EP 0375179 A2 (1989). The documents relate to manufacturing processes for copper-coated aluminum; however, usually little is said about the mechanical and thermal resilience of the products. It is also noteworthy that the same objective has been repeatedly pursued over the decades. On the one hand, this might be due to new technologies and newly available auxiliary substances ("agents"), but on the other hand it indicates that for a long time no fully satisfactory option for producing a stable Al—Cu connector was found.

U.S. Pat. No. 3,335,072 discloses a method for producing lithographic plates in which copper is deposited on an aluminum surface, with the intention of forming a firmly adhering connection.

From the production of electrolytic capacitors, etching processes are known which primarily serve the effective surface enlargement of aluminum and its technical alloys, for example disclosed in the documents DE 14 96 956 A1, EP 0003125 A1, U.S. Pat. Nos. 4,588,486, 6,238,810 B1, 6,858,126 B1, US 2009/0273885 A1, US 2013/0264196 A1. The structures achievable on the surface of an aluminum body form a rugged landscape of aluminum pillars, interspersed with deep pores with steps and undercuts, which typically appear like carelessly stacked packets and are still firmly attached to the body at their lower ends, for example as shown in FIG. 1 in two magnifications.

The inventors have dealt more closely with the scientific investigation of the aluminum structures shown in FIG. 1, and they have given the attribute "sculptured" to aluminum with such structures due to the appearance of the verticals, which are anything but smooth.

Of course, even these structures become coated in the shortest possible time in the air with an aluminum oxide film.

The invention is involves the task of forming a heterostructure of copper and aluminum, which has very good electrical and thermal conductivity and retains this even under high mechanical stress.

The object is solved by a heterostructure comprising at least a first surface comprising only copper and at least a second surface opposite the first surface comprising only aluminum or an aluminum alloy, characterized by a. an anchoring layer disposed between the first and second surfaces, wherein
b. each slice plane running perpendicular to the anchoring layer has at least one aluminum or aluminum-alloy island surrounded by copper, and
c. at most the aluminum alloy solid solutions which are present in the alloy occur in the anchoring layer.

The dependent claims indicate advantageous embodiments. Furthermore, a claim is directed to a manufacturing method for the hetero structure.

For the sake of clarification, it should be noted that the above-mentioned surfaces can generally describe arbitrarily shaped finite surfaces also within a body. It is assumed only that copper is present at each point of the first surface and aluminum or aluminum alloy at every point of the second surface. Usually, the two surfaces are flat surfaces, but this is not necessary. Usually at least one of the surfaces, generally the first surface aligns with the surface of a body. For example, if a body of aluminum is to carry copper on a portion of its surface, then that copper-plated sub-surface may be the first surface and a plane within the body can be the second surface.

Furthermore, it should be clarified that feature c. should be understood such that a heterostructure of copper and pure aluminum according to the invention has no mixed crystals whatsoever, while heterostructures of copper and an aluminum alloy exhibit only the mixed crystals already present in the alloy. In other words, the heterostructure itself does not form new mixed crystals, either during their production or at a later date.

The heterostructure according to the invention can be produced in any aluminum bodies. They can be prepared by an etching attack to produce "sculptured" aluminum and subsequent electrodeposition of copper from an aqueous solution to the etched area. According to the invention, a two-stage process is proposed in which the production of the etched structures is separate from the coating of the "sculptured" aluminum surface with copper. This is beneficial for the reproducibility and cost-effectiveness of the production process. The thickness of the deposited copper layer can be chosen freely.

In particular, such an aluminum body can be provided on a part of its surface with a thick copper layer, which can not be detached either by mechanical deformation nor by thermal cycling. An aluminum body with copper coating comprising the heterostructure according to the invention is an excellent Al—Cu connector. The copper layer can be contacted as a solid copper body or wire electrically and thermally.

The heterostructure according to the invention comprises an anchoring layer between the first surface (copper layer) and the second surface (in the aluminum body) with a layer thickness preferably between 0.5 and 100 micrometers, more preferably between 10 and 50 micrometers. The anchoring layer itself makes only a negligible contribution to the ohmic resistance because copper and aluminum are in perfect contact throughout the anchoring layer.

There are no intermetallic phases in the anchoring layer due to the application of electricity or thermal cycling. One reason for this is that "sculptured" aluminum has already reached its electrochemically most stable surface state by the etching process of the structuring and no longer has a great tendency to diffusion processes. Moreover, there is no possibility for crevice corrosion at the interface between the aluminum body and the copper layer, because the "sculptured" aluminum surface, due to its three-dimensionally interlocked surface structure, does not allow widening of the gap even if the copper layer is mechanically damaged. Thus, one of the main causes of corrosion is eliminated.

Figure 2:
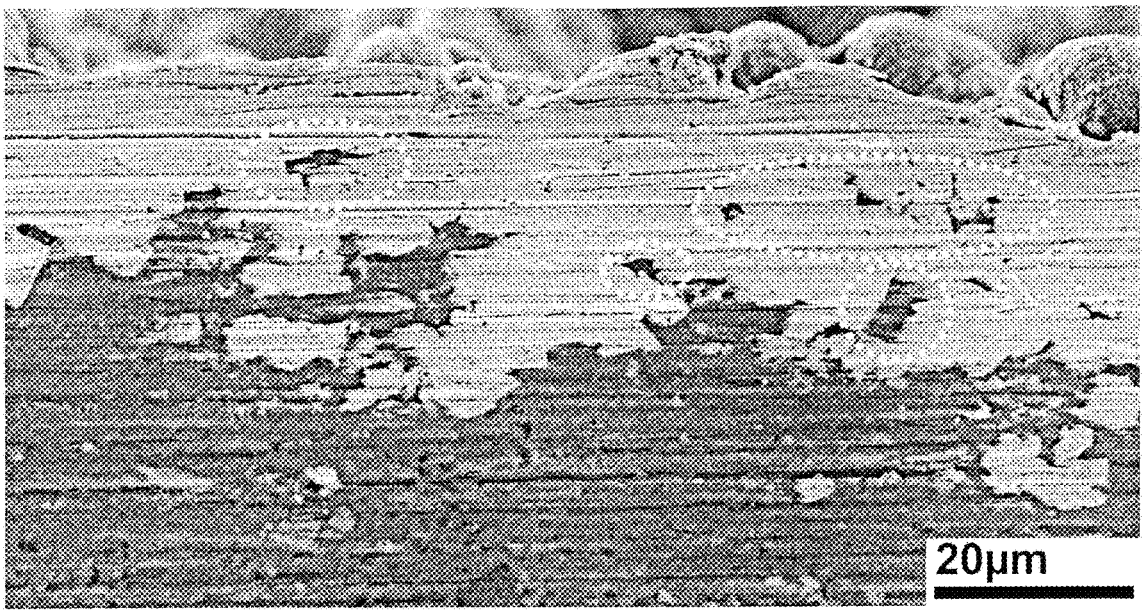
Figure 3:
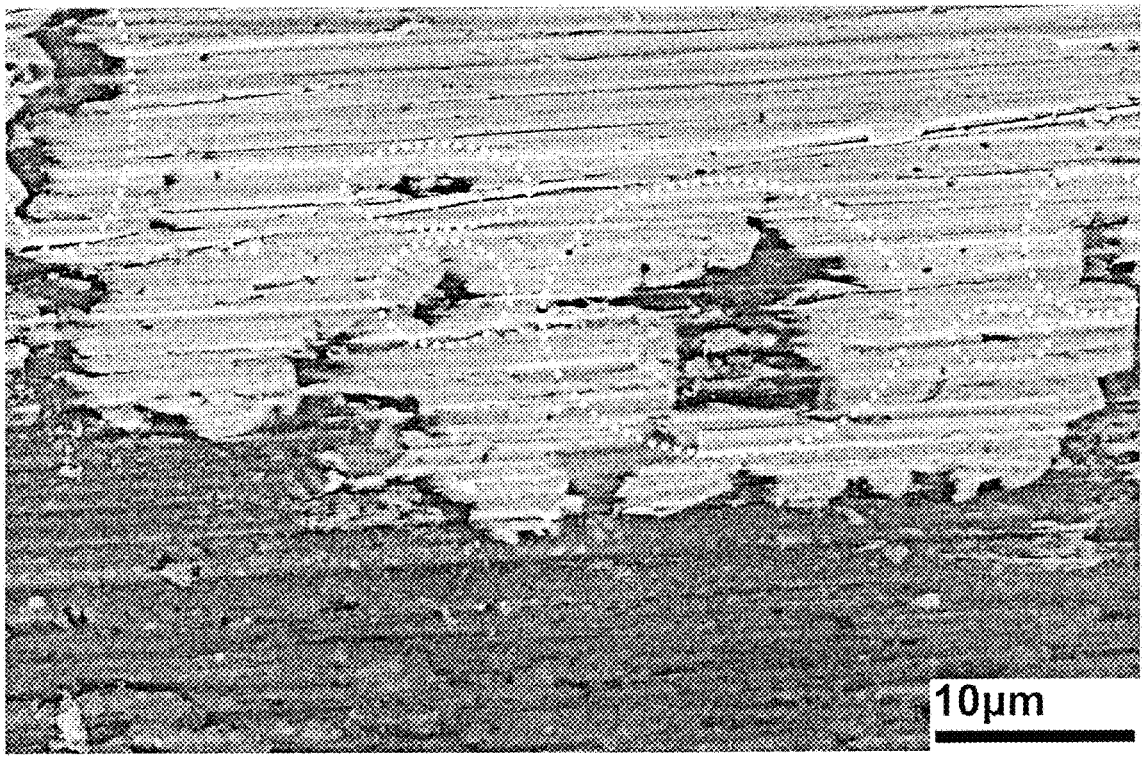
Figure 4:
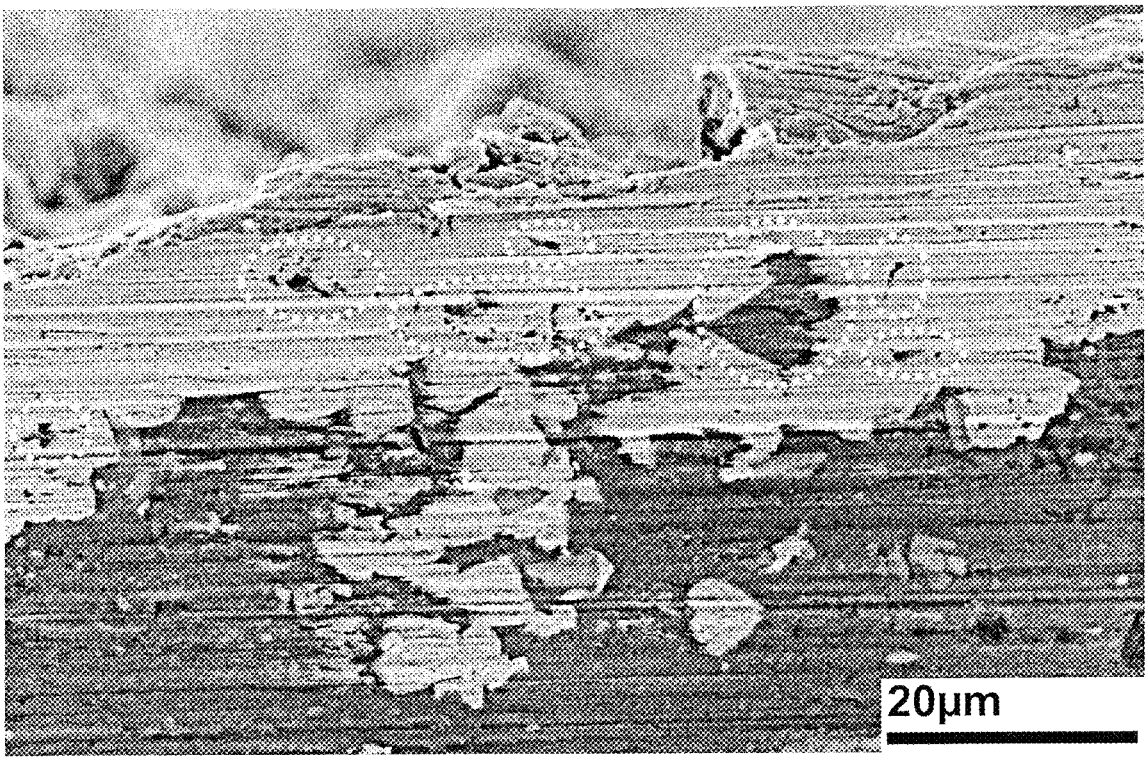
Figure 5:
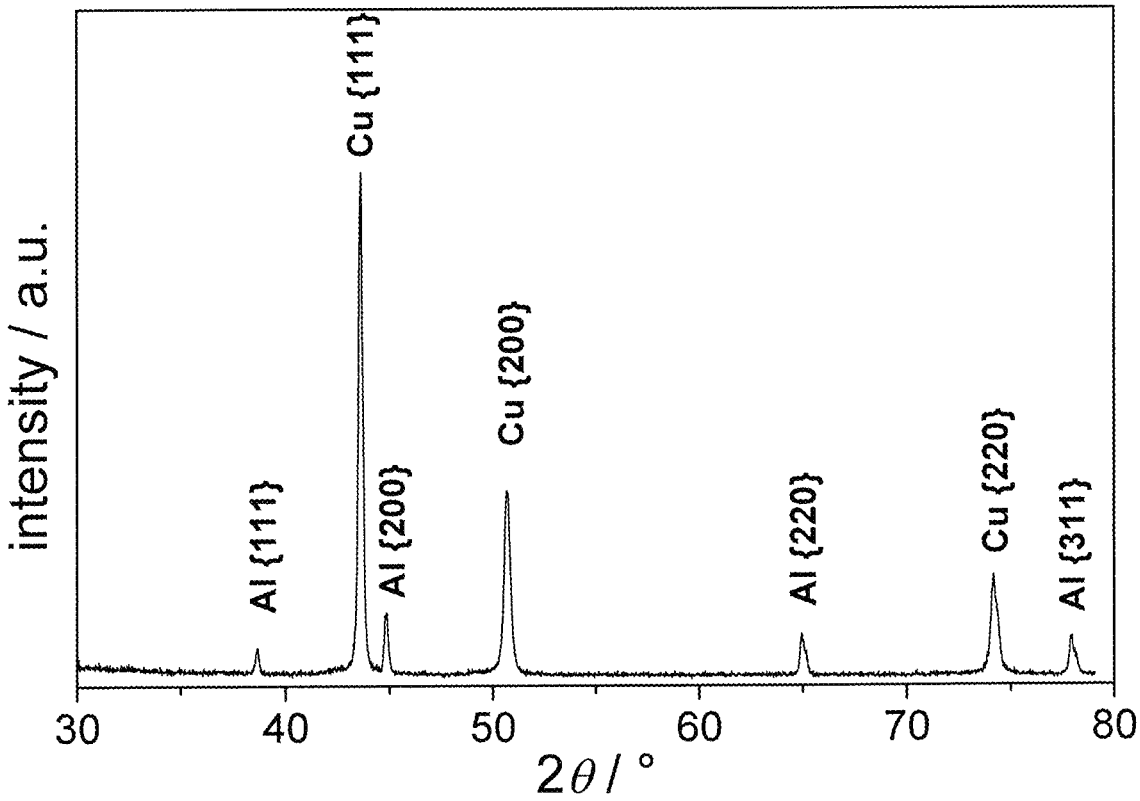
Figure 6:
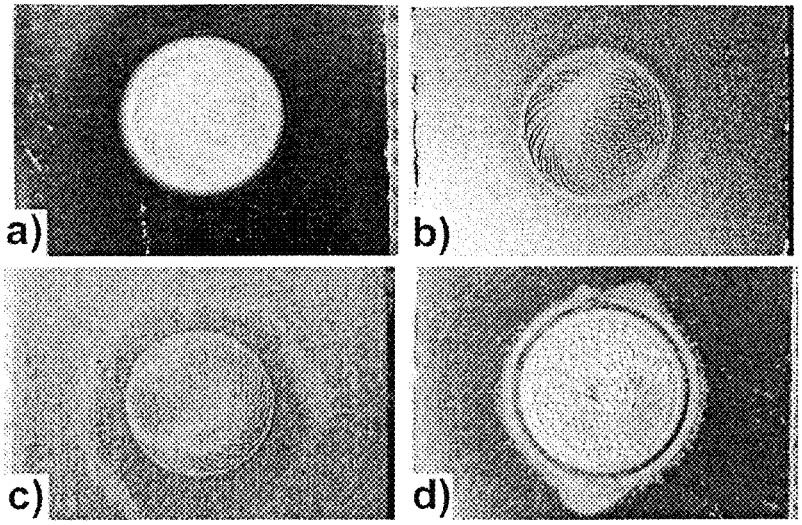
Figure 7:
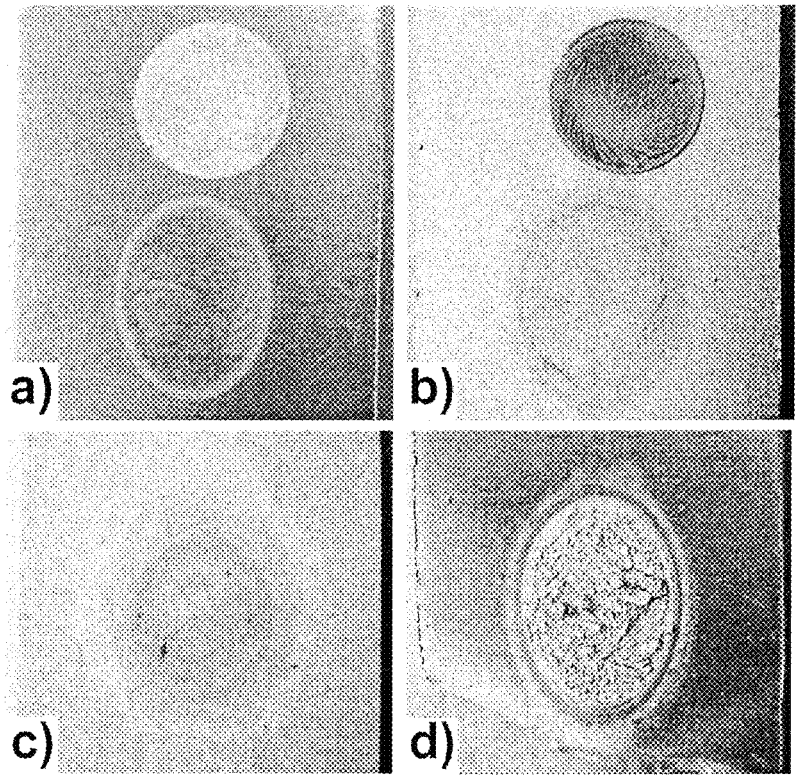

Figures are used to further illustrate the invention. There is shown in:

FIG. 1 images of "sculptured" aluminum in two magnifications (prior art);

FIG. 2 a photograph of a sectional surface perpendicular to the anchoring layer;

FIG. 3 a photograph of a sectional surface perpendicular to the anchoring layer;

FIG. 4 a photograph of a sectional surface perpendicular to the anchoring layer;

FIG. 5 an X-ray diffractogram of the anchoring layer;

FIG. 6 photographs of copper deposits on aluminum strips after various pretreatments of the strips;

FIG. 7 photographs of the copper deposits of FIG. 6 after mechanical stretching of the strips.

In FIGS. 2 to 4, various sections through heterostructures are photographed with an electron microscope. The heterostructures consist here for example of rectangular strips of the technical alloy AlMg3 (>94% Al content) and circular copper thick films deposited on the aluminum. The cross-sectional images each show the surroundings of the copper-bearing surface and represent light copper (upper part of the image) and dark AlMg3 (lower part of the image). The anchoring layer can be recognized by the fact that it has both bright and dark parts of the image and thereby follows the course of the copper-plated partial surface of the aluminum strip. It is particularly noticeable that in each of the sections of copper completely enclosed islands of aluminum (here: AlMg3) can be seen—highlighted in the pictures by dashed borders.

This initially gives the impression that aluminum fragments, such as grains, have somehow been mixed into the copper. However, all aluminum visible in FIGS. 2 to 4 is—at least before generating the cut surface—is definitely connected to the aluminum strip at the bottom of the picture, in particular electrically connected. The extremely nested and sideways cantilevered structure of the "sculptured" aluminum makes it virtually impossible to find a cut surface perpendicular to the anchoring layer in which at least one aluminum island surrounded by copper cannot be seen. This property of the heterostructure is thus very well suited as one of its characteristics.

Another characteristic of the heterostructure can be found in an X-ray diffractogram of the anchoring layer, which is shown in FIG. 5. All occurring peaks of the X-ray scattering can be unambiguously assigned to the usual crystallites, existing previously in pure copper and pure aluminum or, here, the alloy AlMg3. This is also the case after energizing and after treatment in an aging cabinet under cyclic temperature fluctuations. At no time do new mixed crystals form.

The two aforementioned properties of the heterostructure have the consequence that copper and aluminum are mechanically robust and permanently connected by a key-lock principle ("interlocking") and also remain so because corrosion, aging and the formation of brittle intermetallic phases are avoided.

The following experiment demonstrates how good the adhesion is in comparison to copper-plated aluminum according to the prior art:

One strip of AlMg3 is first pre-treated and then covered with a galvanically deposited copper layer. The samples can be seen in FIG. 6, the aluminum strips being a) polished, b) sandblasted on the basis of U.S. Pat. No. 1,457,149 and c) "etched" in accordance with the invention. FIG. 6*d*) shows a coating of copper on aluminum according to the teaching of U.S. Pat. No. 2,495,941.

The copper-plated aluminum strips are then mechanically stretched beyond the elastic range. FIG. 7 shows the experimental results.

With the lengthened polished and sandblasted aluminum strips, the copper layers simply break off as a whole. In FIGS. 7*a*) and *b*) they are placed again on the strips for the photographs. In the lower photograph areas, the areas are recognizable, where they were previously contacted with the strip.

The strip with the heterostructure according to the invention in FIG. 7*c*) retains a perfectly adherent copper layer even during stretching; this was stretched together with the aluminum. There are no signs of damage to the coating integrity.

In FIG. 7*d*), the copper layer also stretches with the strip, however the layer ruptures. It can be concluded that the force application of the expanding aluminum to the copper layer was not uniform everywhere, i.e. there were areas of better and worse adhesion under the copper layer. This is also supported by the visible delamination of parts of the copper layer. In the cracks of the copper layer the aluminum substrate is visible, i.e. there was a partial detachment instead.

The heterostructure according to the invention avoids the delamination and the degradation of the electrical and thermal conductivity under mechanical, electrical and thermal stress.

Preferably, therefore, an aluminum-copper connector is created by producing a body of aluminum or an aluminum alloy having at least one copper-plated partial surface having a heterostructure according to the invention. In this case, the anchoring layer should follow the course of the copper-plated partial surface at a predetermined depth below the copper-plated partial surface.

In an advantageous embodiment for electrical conduction the Al—Cu connector is formed as an aluminum cable—with freely selected cross-section, possibly surrounded by insulation—with at least one copper-plated cable end. If insulation completely covers all non-coppered aluminum surfaces, the cable behaves virtually like a full copper cable and can be so used as well.

A further advantageous embodiment of an Al—Cu connector is the equipment of a commercially available aluminum heat sink, preferably a heat sink filled with water or other cooling liquid, with at least one copper-plated partial surface. Pure copper is too heavy and too expensive as a heat sink, but the rapid removal of heat from the place of origin into the heat sink is thus promoted.

Finally, a two-step process for the generation of the heterostructure will be presented.

For the electrochemical etching of the "sculptured" aluminum surfaces with steps and undercuts a salt water solution is used as etching electrolyte, the common salt (NaCl) with a concentration from the interval of 200 mmol/l to 800 mmol/l and sodium sulfate (Na2SO4) with a concentration of 5 mmol/l to 100 mmol/l. For silicon-containing aluminum alloys such as AA4018, sodium fluoride (NaF) with a concentration in the interval from 5 mmol/l to 100 mmol/l can additionally be added to the etching electrolyte.

As an advantage, it should be emphasized that the etching electrolyte has a chemical composition similar to seawater and contains no critical environmental toxins. It can be easily and inexpensively manufactured and disposed of again.

In the electrochemical etching of pore structures in semiconductors and metals, it is basically the case that the shape of the structures achieved is determined by the passivation of surfaces against the etching attack. The passivation takes place by the addition of at least one passivation species to the vulnerable surface, which slows down the etching in the attachment or even prevented. The passivation species can be very different, for example, chlorine-containing molecules or phosphate or sulfate ions can passivate. US 2013/0264196 A1 proposes, inter alia, the addition of sodium nitrate (NaNO3) as a passivation species, using high concentrations which stabilize the pore walls. At the same time, etch current densities of 100 to 1000 mA/cm 2 are used, so that etching still takes place at the pore tips, because the passivation species does not reach the pore tips adequately by diffusion limitation. This then leads to drilling (drilling) deeper, tunnel-like pores in aluminum.

The etching electrolyte of the present invention relies primarily on chlorine ion-containing molecules as the passivation species. By an inventively low etch current density in the range between 10 mA/cm$^2$ and 100 mA/cm$^2$ and etch bath temperature between 10° C. and 40° C., an advantageous reaction kinetics can be achieved with the etching electrolyte, i.e. that sets up a ratio between passivation and resolution of the aluminum surface favorable for structuring. In particular, there is nowhere a diffusion limitation of the passivation species, but in particular it is uniformly slowly etched everywhere.

Outside the mentioned temperature range, the reaction kinetics is noticeably impaired. In addition, if the etching current density is too great or too small, either a diffusion limitation of the passivation species occurs, or the passivation cannot be interrupted, so that in both cases formation of the desired structures does not occur.

For the copper deposition, a galvanic electrolyte is provided which contains an aqueous solution containing copper sulfate (CuSO4) with a concentration in the interval from 40 mmol/l to 120 mmol/l, boric acid (H3BO3) with a concentration in the interval from 10 mmol/l to 30 mmol/l and polyethylene glycol (PEG) with a concentration in the interval from 0.15 mmol/l to 0.55 mmol/l. Each of the three components has a specific function within the electrolyte. Copper sulfate serves as a source of copper ions, boric acid and polyethylene glycol are necessary to control copper deposition kinetics to completely encase the sculptured aluminum surface structures and eliminate copper voiding in the heterostructure. It is also important for copper deposition on the sculptured aluminum surface that the naturally formed aluminum oxide layer be dissolved in the copper electrolyte while at the same time not destroying the etched aluminum surface structures by chemical dissolution. The deposition current density should be set in the range between 1 mA/cm$^2$ and 30 mA/cm$^2$. At a higher current density, voids may form in the heterostructure, while at too low a current density, copper deposition may be too slow.

The copper deposited in the region of the etched aluminum surface structures, together with the said structures, form the anchoring layer by mechanical positive locking, which is the essential feature of the heterostructure of copper and aluminum according to the invention.

The process for producing a heterostructure according to the invention should in summary comprise at least the following steps:

a. Providing an etching bath with an aqueous etching electrolyte containing between 200 mmol/l and 800 mmol/l sodium chloride and between 5 mmol/l and 100 mmol/l sodium sulfate;
b. Providing a plating bath with an aqueous electroplating electrolyte containing between 40 mmol/l and 120 mmol/l copper sulfate and between 10 mmol/l and 30 mmol/l boric acid and between 0.15 mmol/l and 0.55 mmol/l polyethylene glycol;
c. Introducing an electrically contacted object made of aluminum or an aluminum alloy and a counter electrode into the etching bath;
d. Applying and keeping constant an etching current density at the interval of 10 mA/cm 2 to 100 mA/cm 2 for a predetermined etching time at a predetermined temperature;
e. Introducing the etched object and a counter electrode into the plating bath;
f. Applying and keeping constant a deposition current density from the interval of 1 mA/cm2 to 30 mA/cm2.

As a concrete example of the method for producing a heterostructure comparable to that of FIG. 6*c*), the following procedure is adopted:

First, a polycrystalline aluminum alloy rolled strip (e.g. AA5754) is patterned on its surface by electrochemical etching. The etching electrolyte for this purpose is water containing 500 mmol/l NaCl and 56 mmol/l Na2SO4. The aluminum structuring is carried out galvanostatically at a constant current density of about 50 mA/cm$^2$.

The etching time depends on the selected etching current density, on the composition and temperature of the etching electrolyte and on the desired structural depth in the aluminum; it is here for example 30 min. The person skilled in electrochemistry is familiar with the fact that when changing an etching parameter, he has to adapt the etching time to the new conditions, which he can accomplish easily by means of simple preliminary experiments.

The galvanic copper deposition, with which the aluminum-copper heterostructure is produced, takes place in an aqueous electroplating electrolyte containing 72.1 mmol/l copper sulfate, 17.8 mmol/l boric acid and 0.33 mmol/l polyethylene glycol 3350. The deposition is carried out galvanostatically at a current density of 15 $mA/cm^2$. The deposition time is freely selectable in view of the selected deposition current density and the desired copper layer thickness. The electrolyte temperature here is 20° C. in both baths.

Another advantage of the above-described two-stage process in two separate electrolyte baths is that the electrolytic plating bath for copper deposition is not contaminated with aluminum etchants. This ensures that the reproducibility of the deposition process and the purity of the deposited copper layer are high, which also simplifies the control of the electrical resistance of the heterostructures. The division into an etching bath and a deposition bath also advantageously increases the service lives of the electrolytes. If the electroplating electrolyte is depleted of copper, it can easily be re-enriched with copper in-situ—e.g. by means of copper counter-electrode—or ex-situ.

The invention claimed is:

1. A heterostructure comprising at least one first surface containing only copper and at least one second surface, opposite the first surface, containing only aluminum or an aluminum alloy with solid solutions present in the alloy, wherein a. an anchoring layer is arranged between the first and second surfaces, wherein b. each slice plane running perpendicular to the anchoring layer has at least one aluminum or aluminum-alloy island surrounded by copper, c. any aluminum alloy solid solutions present in the alloy are in the anchoring layer, d. the islands of aluminum or aluminum alloy enclosed by copper have nested and sideways protruding cantilevered structure, e. if the heterostructure is made of copper and pure aluminum, there are no mixed crystals at all, and if the heterostructure is made of copper and aluminum alloy, any mixed crystals present in the heterostructure were pre-existing in the alloy prior to forming the heterostructure and the forming of the heterostructure has not formed any new solid solution crystals, and f. the thickness of the anchoring layer is between 0.5 and 100 micrometers.

2. The heterostructure according to claim 1, wherein an X-ray diffractogram of the anchoring layer shows only the crystallites of copper and aluminum or aluminum alloy which also occurred in the bulk materials.

3. The heterostructure according to claim 1, wherein the thickness of the anchoring layer is between 10 and 50 micrometers.

* * * * *